United States Patent [19]

Houle

[11] Patent Number: 4,786,383

[45] Date of Patent: Nov. 22, 1988

[54] CATHODIC PROTECTION SYSTEM FOR A WATER HEATER TANK

[75] Inventor: Timothy H. Houle, Wauwatosa, Wis.

[73] Assignee: A. O. Smith Corporation, Milwaukee, Wis.

[21] Appl. No.: 30,081

[22] Filed: Mar. 26, 1987

[51] Int. Cl.[4] ..... C23F 13/00

[52] U.S. Cl. ..... 204/148; 204/197

[58] Field of Search ..... 204/147, 148, 196, 197

[56] References Cited

U.S. PATENT DOCUMENTS

| | | | |
|---|---|---|---|
| 2,486,871 | 11/1949 | Osterheld | 204/197 |
| 2,568,594 | 9/1951 | Robinson | 204/197 |
| 2,616,844 | 11/1952 | Klumb | 204/197 |
| 2,656,314 | 10/1953 | Osterheld | 204/197 |
| 2,852,462 | 9/1958 | Andrus | 204/197 |
| 3,332,867 | 7/1967 | Miller et al. | 204/197 |
| 3,558,463 | 1/1971 | Strobach et al. | 204/197 |
| 3,867,274 | 2/1975 | Herman | 204/197 |
| 3,928,155 | 12/1975 | Woodhouse | 205/150 |
| 4,093,529 | 6/1978 | Strobach | 204/197 |
| 4,224,126 | 9/1980 | Bidwell | 204/197 |
| 4,381,981 | 5/1983 | Maes | 204/197 |
| 4,699,703 | 10/1987 | Norman | 204/196 |

*Primary Examiner*—T. Tung

*Attorney, Agent, or Firm*—Andrus, Sceales, Starke & Sawall

[57] ABSTRACT

A cathodic protection system for a water heater tank incorporating a resistor anode assembly. The steel water heater tank is provided with an opening and an internally threaded spud is secured to the outer surface of the tank bordering the opening. An anode rod composed of a metal electro-positive to steel extends through the opening to the interior of the tank and the anode is connected to the spud by an electrically conductive plastic cap. The cap provides a resistance to the flow of current between the anode rod and the steel tank to reduce the consumption of the anode.

13 Claims, 1 Drawing Sheet

CATHODIC PROTECTION SYSTEM FOR A WATER HEATER TANK

BACKGROUND OF THE INVENTION

Water heater tanks are normally formed of steel and to prevent corrosion of the steel tank, corrosion resistant coatings, such as glass or porcelain enamel are applied to the inner surface of the tank. However, it has been found that intensified corrosion can occur in areas of the steel tank exposed through defects in the glass coating, or in inadequately coated portions of the steel tank. Further, steel fittings or connectors that may be exposed to the water of the tank are also subject to corrosion. To prevent this corrosion, sacrificial anodes formed of a metal electro-positive to steel, such as aluminum, magnesium, zinc, or alloys thereof, are normally mounted within the tank. The anode is electrically connected to the steel tank and a galvanic circuit is established which will preferentially corrode the anode.

The service life of the anode is dependent on the magnitude of the galvanic current generated in the cathodic protection system. In certain water supplies having a high mineral content, the current flow will be relatively high, resulting in a corresponding increase in the consumption of the anode and a corresponding decrease in the service life of the anode.

In order to reduce the consumption of the anode in a water heater tank, it has been proposed to connect a resistor in the galvanic circuit to limit the amount of current flow and, therefore, extend the service life of the anode. For example U.S. Pat. No. 4,093,529 shows a disc-like resistor, while other anode assemblies have included resistors in the form of wires or coils, as disclosed in U.S. Pat. Nos. 2,656,314, 2,568,594, 2,616,844, and 2,486,871. In addition, it has been proposed to employ a metal silicon oxide semiconductor in the galvanic circuit to act as a current control element, as disclosed in U.S. Pat. No. 4,381,981.

SUMMARY OF THE INVENTION

The invention is directed to an improved cathodic protection system for a water heater tank incorporating a unique resistor anode assembly. The steel water heater tank is provided with an opening and an internally threaded spud is welded to the outer surface of the tank bordering the opening. An anode composed of a metal electropositive to steel, such as aluminum, magnesium, zinc, or alloys thereof, extends through the opening into the interior of the tank, and the anode is connected to the spud through an electrically conductive plastic cap.

The cap is formed of a material such as acetal resin containing short fibers or particles of graphite. While the cap is capable of conducting an electric current, it provides resistance to the flow of current between the anode and the tank to thereby reduce consumption of the anode, and correspondingly increase the service life.

The cap is provided with a tapered external thread that is engaged with the threaded spud, and the inner end of the cap defines an annular skirt which extends through the opening in the tank into the interior and acts to protect or shield the outer end of the anode to prevent intensified corrosion of that portion of the anode due to the presence of any exposed steel parts in that region of the tank.

The electrically conductive cap provides a dual function, not only serving to support the anode within the tank, but also acting as a resistor to reduce the galvanic current flow and provide a substantial increase in the service life of the anode.

The invention eliminates the need for auxiliary resistor elements, as used in the past, and thereby results in a simplified and less expensive cathodic protection system.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
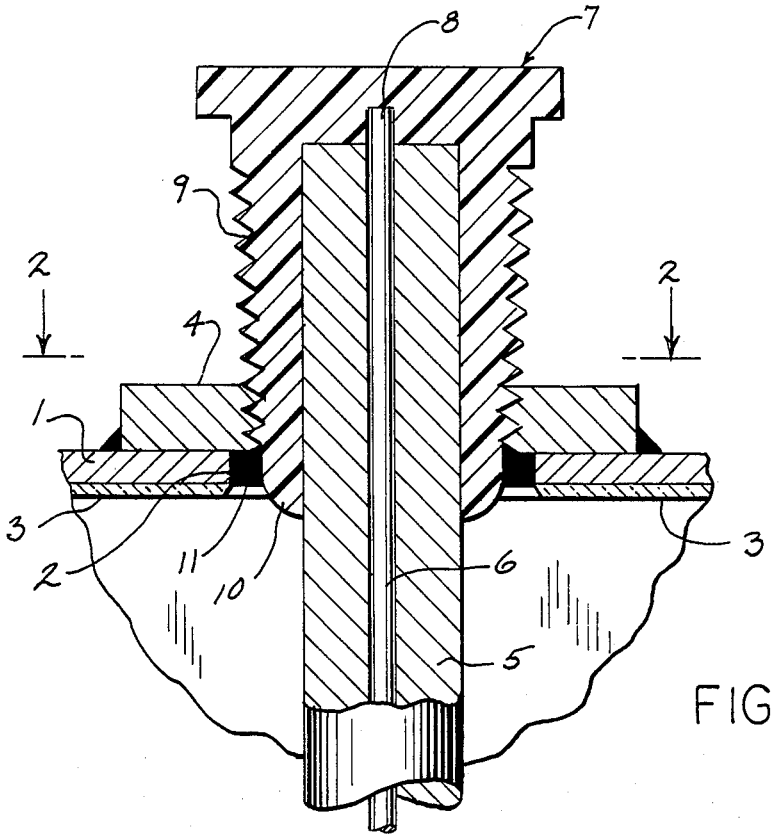
FIG. 1 is a vertical section of the upper portion of a water heater tank incorporating the cathodic protection sytem of the invention.
Figure 2:
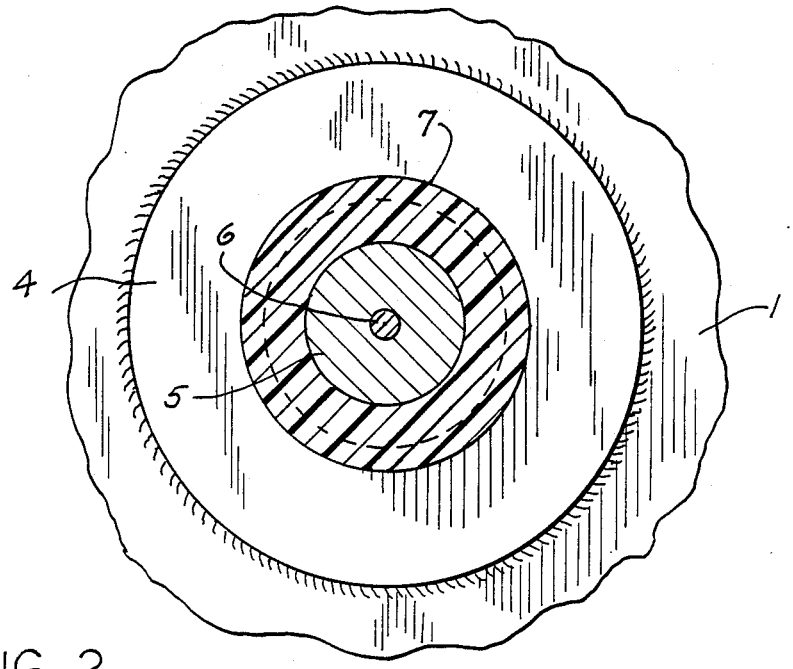
FIG. 2 is a section taken along line 2—2 of FIG. 1.

FIG. 1 illustrates a portion of the upper end of a water heater tank, including a steel upper head 1 having an opening 2. The inner surface of the tank, including head 1, is coated with a layer 3 of a corrosion resistant material such as glass or resin, and the coating 3 extends up to the edge of head 1 bordering opening 2. An internally threaded steel spud 4 is welded to the outer surface of tank head 1 and a rod-like anode 5 extends through opening 2 into the interior of the tank.

Anode 5 is formed of a metal electropositive to steel, such as aluminum, magnesium, zinc or alloys thereof, and is supported by a central steel core wire 6. In normal practice, the anode 5 will extend downwardly to a location adjacent the lower head of the tank.

In accordance with the invention, the anode 5 is supported from spud 4 through a cap 7 formed of an electrically conductive molded plastic material. Cap 7 is provided with a downwardly facing central bore 8, which receives the upper end of anode 5 and the upper end 8 of core wire 6 projects beyond the end of anode 5 and is integrally molded to cap 7 to provide a tight leakproof attachment between the core wire 6 and cap 7.

As shown in FIG. 1, cap 7 is provided with a tapered external thread 9 which is engaged with the internal thread of spud 4 to retain the cap and anode in the tank. In addition, the inner end of cap 7 defines an annular skirt 10, which projects through opening 2 into the interior of the tank and a suitable sealant 11 is disposed between the outer surface of skirt 10 and the edge of head 1 bordering opening 2 to seal the steel spud 4 and edge 2 against exposure to the interior of the tank.

The sealant 11 can take the form of a hot-melt thermoplastic resin which can be applied to edge 2 and to the thread 9 of cap 7 before the cap is threaded in the spud. As the cap is threaded down, the hot-melt resin will provide an adherent seal between the members, as shown in FIG. 1.

Cap 6 is formed of a plastic or resin material, such as acetal resin containing particles of an electrically conductive material, such as graphite. The particles may take the form of powder or short chopped fibers. This material provides a strong rigid cap construction and yet is electrically conductive to provide an electrical connection between the anode and the spud 4 and tank head 1. The conductivity of cap 7 can be adjusted to provide the desired resistance in the galvanic circuit by varying the proportion of the conductive particles in the resin.

By molding the cap 7 directly to the projecting end 8 of core wire 6, a positive electrical and leak-proof connection is provided between the members.

The sealant 11 and skirt 10 prevent increased consumption of the outer end of the anode which can result in "necking down" of the anode adjacent the tank wall.

While the drawings show the anode 5 supported from upper tank head 1, it is contemplated that in other installations the anode may be supported from other portions of the tank.

Various modes of carrying out the invention are contemplated as being within the scope of the following claims particularly pointing out and distinctly claiming the subject matter which is regarded as the invention.

I claim:

1. A cathodic protection system, comprising a steel tank having an opening therein, a steel spud secured to the outer surface of said tank and bordering said opening, said spud having a central bore, an anode composed of a metal electropositive to steel and extending from an end thereof through said opening into the interior of the tank, and an electrically conductive plastic cap located on the outside of said tank and connecting said end of the anode to said spud, said cap having a given resistance to the flow of current between said anode and said tank to decrease the consumption of said anode.

2. The system of claim 1, and including a corrosion resistant coating disposed on the inner surface of said tank bordering said opening.

3. The system of claim 1, wherein said bore is threaded and said cap is provided with an external thread engaged with said threaded bore.

4. The system of claim 1, wherein said metal is selected from the group consisting of aluminum, magnesium, zinc and alloys thereof.

5. The system of claim 1, and including a steel core wire disposed in said anode and connected to said cap.

6. The system of claim 5, wherein an end of said core wire projects outwardly beyond the corresponding end of said anode, said projecting end being integrally molded to said cap.

7. The system of claim 6, wherein said cap is provided with an axial recess that extends only partially through said cap, said projecting end being disposed in said recess.

8. The system of claim 1, and including an annular skirt on an end of said cap and extending through said opening into the interior of said tank, and sealing means disposed between the outer peripheral surface of said skirt and an edge of said tank bordering said opening.

9. A cathodic protection system for a water heater, comprising a steel tank having a wall, said wall having an opening therein, a steel spud secured to the outer surface of the wall and bordering said opening and having a central bore, an anode composed of a metal electropositive to steel and extending through said opening to the interior of said tank, the outer periphery of said anode being spaced from the edge of said wall bordering said opening, and an electrically conductive plastic cap located on the outside of said wall and interconnecting an end of said anode with said spud, said cap being formed of a resin and containing particles of an electrically conductive material, said cap providing a given resistance to the flow of current between the anode and said wall to thereby reduce consumption of the anode.

10. The system of claim 9, wherein said particle are graphite.

11. The system of claim 10, wherein said resin is an acetal resin.

12. The system of claim 9, wherein an end of said cap includes an annular skirt extending through said opening into the interior of said tank, and sealing means disposed between the outer peripheral surface of said skirt and the edge of the tank bordering said opening to seal the space therebetween.

13. A method of cathodically protecting a steel tank, comprising the steps of securing an annular steel spud to the outer surface of a steel tank bordering an opening in the tank, forming an anode composed of a steel core wire and an annular body of a metal electropositive to steel surrounding said core wire, projecting an end of the wire beyond the corresponding end of the metal body, molding an electrically conductive plastic cap around an end portion of the body and around the projecting end of the core wire, and securing said cap within the opening of said spud, said plastic cap being formed of a resin and containing particles of an electrically conducting material to provide a given resistance to the flow of current between the anode and the tank to decrease the consumption of the anode.

* * * * *